US006467497B1

(12) United States Patent
Stradinger et al.

(10) Patent No.: US 6,467,497 B1
(45) Date of Patent: Oct. 22, 2002

(54) BUFFER BOX FOR USE IN A VACUUM DRAINAGE SYSTEM

(75) Inventors: Jay D. Stradinger; Douglas M. Wallace, both of Roscoe; Michael B. Hancock, Rockford, all of IL (US)

(73) Assignee: Evac International Oy, Helsinki (FI)

( * ) Notice: Subject to any disclaimer, the term of this patent is extended or adjusted under 35 U.S.C. 154(b) by 0 days.

(21) Appl. No.: 09/295,995

(22) Filed: Apr. 21, 1999

(51) Int. Cl.[7] ..... E03F 1/00; E03F 5/10; B65G 53/00; F16K 31/12

(52) U.S. Cl. ..... 137/205; 4/380; 137/236.1; 137/393; 137/396; 141/65; 141/198; 406/16; 406/23; 406/192

(58) Field of Search ..... 4/316, 323, 380, 4/431; 137/205, 236.1, 393, 395, 396; 406/16, 17, 23, 30, 31, 32, 33, 50, 192; 141/65, 198; 222/66

(56) References Cited

U.S. PATENT DOCUMENTS

| | | | | |
|---|---|---|---|---|
| 3,239,849 A | | 3/1966 | Liljendahl | 4/300 |
| 3,628,194 A | * | 12/1971 | Liljendahl | 137/397 |
| 3,686,693 A | * | 8/1972 | Liljendahl | 4/300 |
| 3,746,032 A | * | 7/1973 | Wallgren | 137/205 |
| 4,120,312 A | | 10/1978 | Michael | 137/236.1 |
| 4,155,851 A | * | 5/1979 | Michael | 210/105 |
| 4,179,371 A | * | 12/1979 | Foreman et al. | 406/50 |
| 4,188,968 A | * | 2/1980 | Trobaugh et al. | 137/236.1 |
| 4,285,359 A | * | 8/1981 | Doherty | 137/205 |
| 4,333,830 A | * | 6/1982 | Michael | 405/39 |
| 4,373,838 A | * | 2/1983 | Foreman et al. | 406/14 |
| 4,603,709 A | * | 8/1986 | Huisma | 137/205 |
| 4,691,731 A | * | 9/1987 | Grooms et al. | 137/205 |
| 5,069,243 A | * | 12/1991 | Foreman | 137/205 |
| 5,074,718 A | * | 12/1991 | Ushitora et al. | 406/151 |
| 5,083,885 A | * | 1/1992 | Ushitora et al. | 137/236.1 |
| 5,100,266 A | * | 3/1992 | Ushitora et al. | 406/120 |
| 5,114,280 A | * | 5/1992 | Ushitora et al. | 406/18 |
| 5,282,281 A | | 2/1994 | Clear et al. | 4/434 |
| 5,297,577 A | * | 3/1994 | Yamanaka | 137/236.1 |
| 5,337,773 A | * | 8/1994 | Michael | 137/1 |
| 5,588,458 A | * | 12/1996 | Ushitora et al. | 137/205 |
| 5,615,701 A | * | 4/1997 | Yamabe et al. | 137/205 |
| 5,673,723 A | * | 10/1997 | Roediger | 137/205 |
| 5,871,027 A | * | 2/1999 | Shimizu et al. | 137/205 |
| 5,918,853 A | * | 7/1999 | Yamabe et al. | 137/205 X |
| 5,979,846 A | * | 11/1999 | Davidson | 137/205 |

FOREIGN PATENT DOCUMENTS

| | | | |
|---|---|---|---|
| EP | 0 328 457 A1 | 8/1989 | E03F/1/00 |

OTHER PUBLICATIONS

Search Report for French Patent Application No. FR 0005084, dated Aug. 3, 2001.

* cited by examiner

*Primary Examiner*—George L. Walton
(74) *Attorney, Agent, or Firm*—Marshall, Gerstein, & Borun.

(57) ABSTRACT

A buffer box for use in a vacuum drainage system. The buffer box defines a reservoir of known effective size which provides substantially consistently sized slugs of liquid which may be efficiently pulled up a vertical lift. The buffer box includes an outlet and an air intake orifice which may be sized relative to one another so that only liquid from the reservoir is evacuated. The outlet has an upper edge which may be spaced from a base portion of the buffer box at a height which optimizes liquid velocity out of the box and defines a level above which only water is evacuated from the reservoir.

28 Claims, 3 Drawing Sheets

BUFFER BOX FOR USE IN A VACUUM DRAINAGE SYSTEM

FIELD OF THE INVENTION

The present invention generally relates to liquid drainage apparatus, and more particularly to vacuum drainage systems for waste water.

BACKGROUND OF THE INVENTION

Health and Environmental agencies require waste water to be collected and directed to a proper receptacle, such as a municipal sewer or private septic tank. The term "waste water" includes used or dirty process water (known as gray water), and sewage water (commonly referred to as black water). Gray water may be generated from a variety of different operations. In a grocery store, for example, water is used in deli, food service, and floral departments for cleaning, maintenance, and other purposes. Refrigerated display cases generate additional process water from condensate and defrost procedures. The waste water generated from these various sources must be collected and transported to the proper receptacle.

In the past, conventional gravity drainage piping has been used to collect and transport waste water. Gravity drainage systems use collection points located below the waste water source which feed into drainage pipes leading to a sewer line. The piping in such systems must be continuously sloped so that the waste water flows all the way to the sewer line. As a result, pipes for gravity drainage systems are often laid in or underneath the concrete pad supporting the facility. This process not only requires significant amounts of additional plumbing work, but also complicates changes in facility layout, which require portions of the concrete pad to be ripped up to expose drainage channels.

More recently, vacuum drainage systems have been used to collect and transport waste water. A vacuum drainage system typically comprises a collection drain located under each waste water source, each collection drain leading to a common drain pipe. The drain pipe is connected to a pump which creates negative pressure in the drain pipe to thereby pull liquid through the drain pipe and into the collection tank. The tank has a drain that is typically positioned over a sewer line to allow the tank to be emptied.

Significantly, vacuum drainage systems allow the use of overhead drainage piping since suction rather than gravity is used to transport the waste water. Vacuum drainage piping does not need to be laid in concrete below the waste water source, but instead may follow overhead electrical and refrigeration service lines. Thus, plumbing layouts are simplified and water generating equipment may be quickly and easily relocated within a facility without ripping up concrete. As a result, greater freedom exists for redesigning the facility layout.

While the use of overhead piping provides certain advantages, the pumps used in vacuum drainage systems are capable of lifting only a limited volume of water from the collection drains to the vacuum drainage piping. Certain systems provide a buffer section consisting of a large diameter pipe into which waste water initially collects. An air intake is provided to allow air at atmospheric pressure to access liquid in the pipe. Once the desired volume of water has collected in the buffer, a valve leading to the vacuum drainage piping is opened so that waste water travels toward the valve. Air entering the intake opening creates a pressure differential across the waste water which acts to lift the waste water toward the vacuum drainage piping. Once the waste water reaches the vacuum drainage piping, the valve shuts so that additional water may collect in the buffer and the process is repeated. In this manner, conventional vacuum drainage systems lift discrete volumes or "slugs" of waste water to the vacuum drainage piping.

It is difficult, however, for such conventional systems to ensure that an appropriate volume of waste water is pulled toward the vacuum drainage piping. Care must be taken so that the slug of waste water is not too large for the pump. Conversely, slugs that are too small cause unduly rapid cycling of the valve. As a result, it is overly difficult to efficiently transport unbroken slugs of liquid using conventional vacuum drainage systems.

SUMMARY OF THE INVENTION

In accordance with certain aspects of the present invention, a vacuum drainage system is provided for evacuating waste water, the system including a pump having an inlet, a collection tank in fluid communication with the pump inlet, a drainage pipe fluidly communicating with the tank, and a valve connected to the drainage pipe. The system also includes a buffer box defining a reservoir and having an outlet in fluid communication with the valve, an inlet allowing fluid flow into the reservoir, and an air intake orifice. The system further includes an activator coupled to the valve and having a sensor which detects fluid level in the reservoir, the activator opening the valve when the sensor detects a particular fluid level height.

The reservoir may be sized to have a known effective volume. In addition, the air intake orifice of the buffer box may be located within an upstream ⅓ of the buffer box, and may have a cross-sectional area at least equal to a cross-sectional area of the inlet. The air intake orifice and outlet may be sized so that a ratio between air intake orifice size to outlet size is approximately 1.7:1. Fluid inlet size to outlet size is preferably 2:1 to 3.5:1. The buffer box may further comprise a pressure chamber depending from a cover portion of the buffer box into the reservoir and fluidly communicating with a sensor port, and the sensor may be a pressure sensor. The outlet of the buffer box may have a fence portion which reduces the height of an upper edge of the outlet.

In accordance with additional aspects of the present invention, a buffer box is provided for use in a liquid evacuation system. The evacuation system includes a pump and a collection tank in fluid communication with an inlet of the pump. A drainage pipe fluidly communicates with the tank and a valve is attached to the drainage pipe. An activator is coupled to the valve and has a liquid level sensor. The buffer box includes a body defining a reservoir for holding a known effective volume of liquid. The body has an inlet which allows liquid to flow into the reservoir, an outlet adapted for fluid communication with the valve, an air intake orifice open to atmosphere, and a sensor port adapted for use with the liquid level sensor. The activator opens the valve when the sensor detects a particular liquid level height in the reservoir.

In accordance with further aspects of the present invention, a method of evacuating liquid from a reservoir up a vertical pipe is provided. The pipe has an upper end in communication with a pump which creates negative pressure in the pipe, a lower end in fluid communication with the reservoir, and a valve located between the pump and the reservoir. The method comprises an initial step of collecting liquid in a buffer box having a known effective volume, the buffer box having an air intake orifice. The valve is then opened to create a pressure differential across the liquid in the buffer box, the pressure differential being formed by the negative pressure in the vertical pipe acting on an upstream end of the liquid and atmospheric air entering through the air intake orifice to act on an upper surface of the liquid collected in the buffer box. The valve is then closed after the liquid passes through the vertical pipe. As a result, substantially consistently sized slugs of water are pulled up the vertical pipe.

Other features and advantages are inherent in the apparatus claimed and disclosed or will become apparent to those skilled in the art from the following detailed description and its accompanying drawings.

DETAILED DESCRIPTION OF THE PREFERRED EMBODIMENTS

Figure 1:
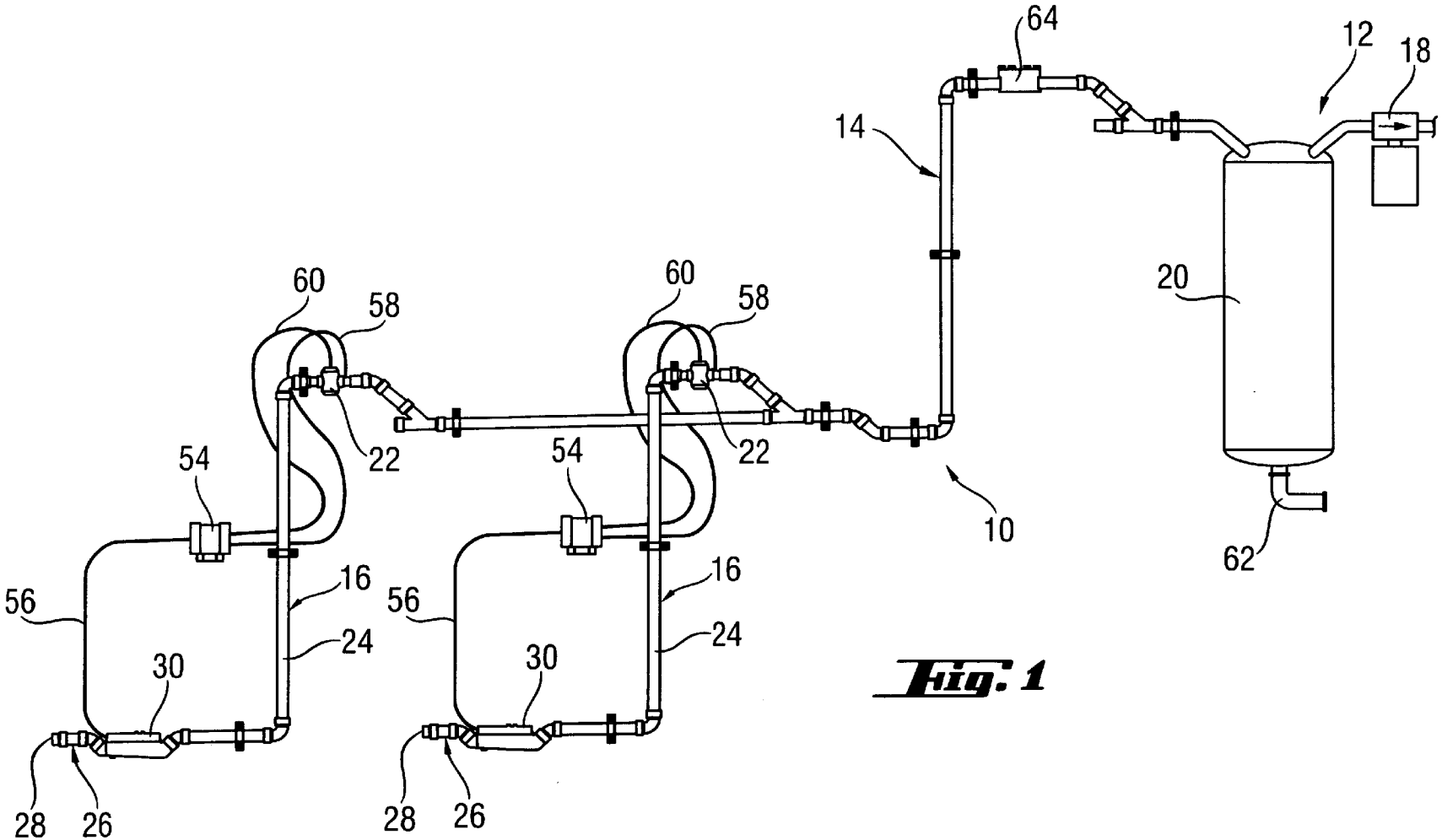
FIG. 1 is a side elevation view of a vacuum drainage system constructed in accordance with the teachings of the present invention.

A vacuum drainage system 10 in accordance with the teachings of the present invention is illustrated in FIG. 1. The illustrated drainage system 10 generally comprises a vacuum central 12 connected by vacuum drainage piping 14 to one or more collection branches 16. The vacuum central 12 comprises a pump 18 and storage tank 20. The vacuum drainage piping 14 extends from the tank 20 to each collection branch 16. Suction valves 22 connect the vacuum drainage piping 14 to each collection branch 16. The suction valves 22 are normally closed so that the pump 18 creates negative pressure in the vacuum drainage piping 14.

Each collection branch 16 generally comprises a vertically extending lift pipe 24 connected to a substantially horizontally extending collection line 26. The connection line 26 has an inlet 28 into which spent process water is directed. The collection line 26 is formed with a downward slope so that liquid flows from the inlet 28 toward the lift pipe 24 under the force of gravity.

Figure 2:
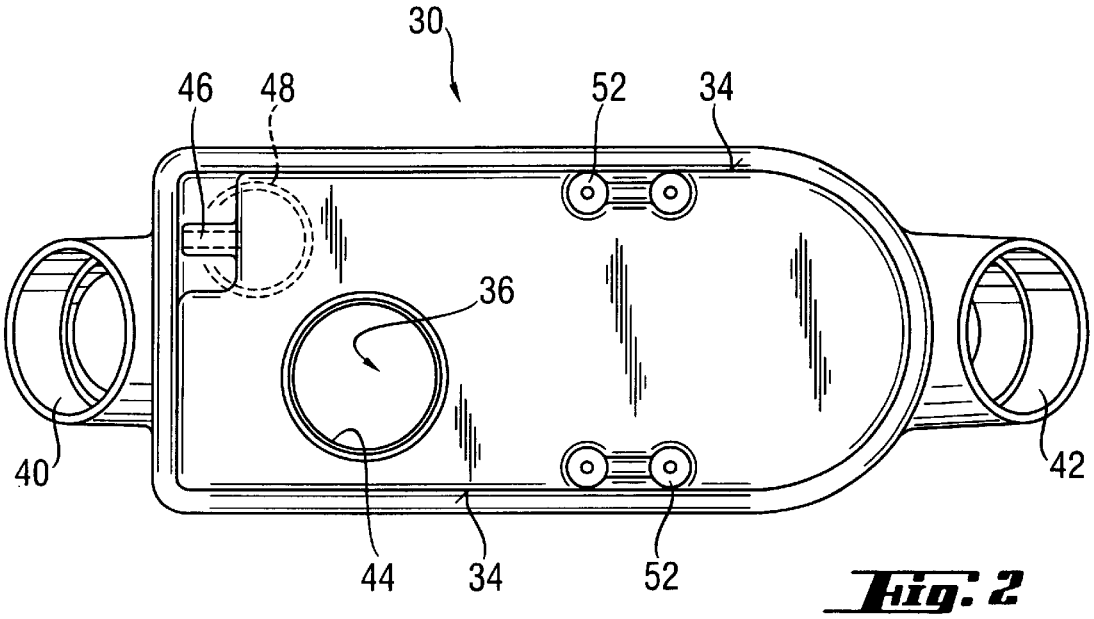
FIG. 2 is a top view of a buffer box constructed in accordance with the teachings of the present invention.
Figure 3:
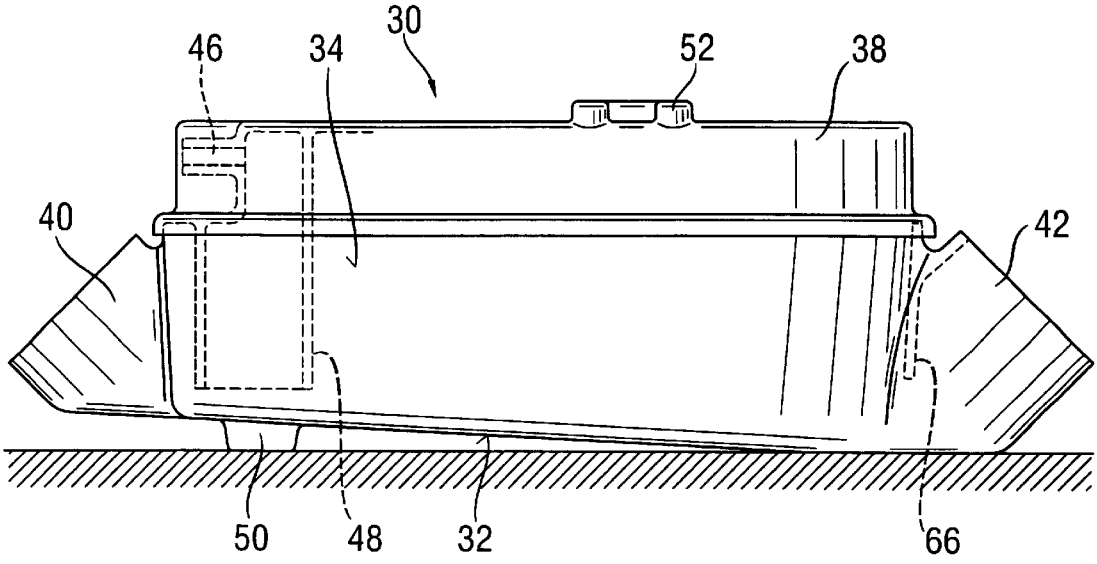
FIG. 3 is a side elevation view of the buffer box of FIG. 2.
Figure 4:
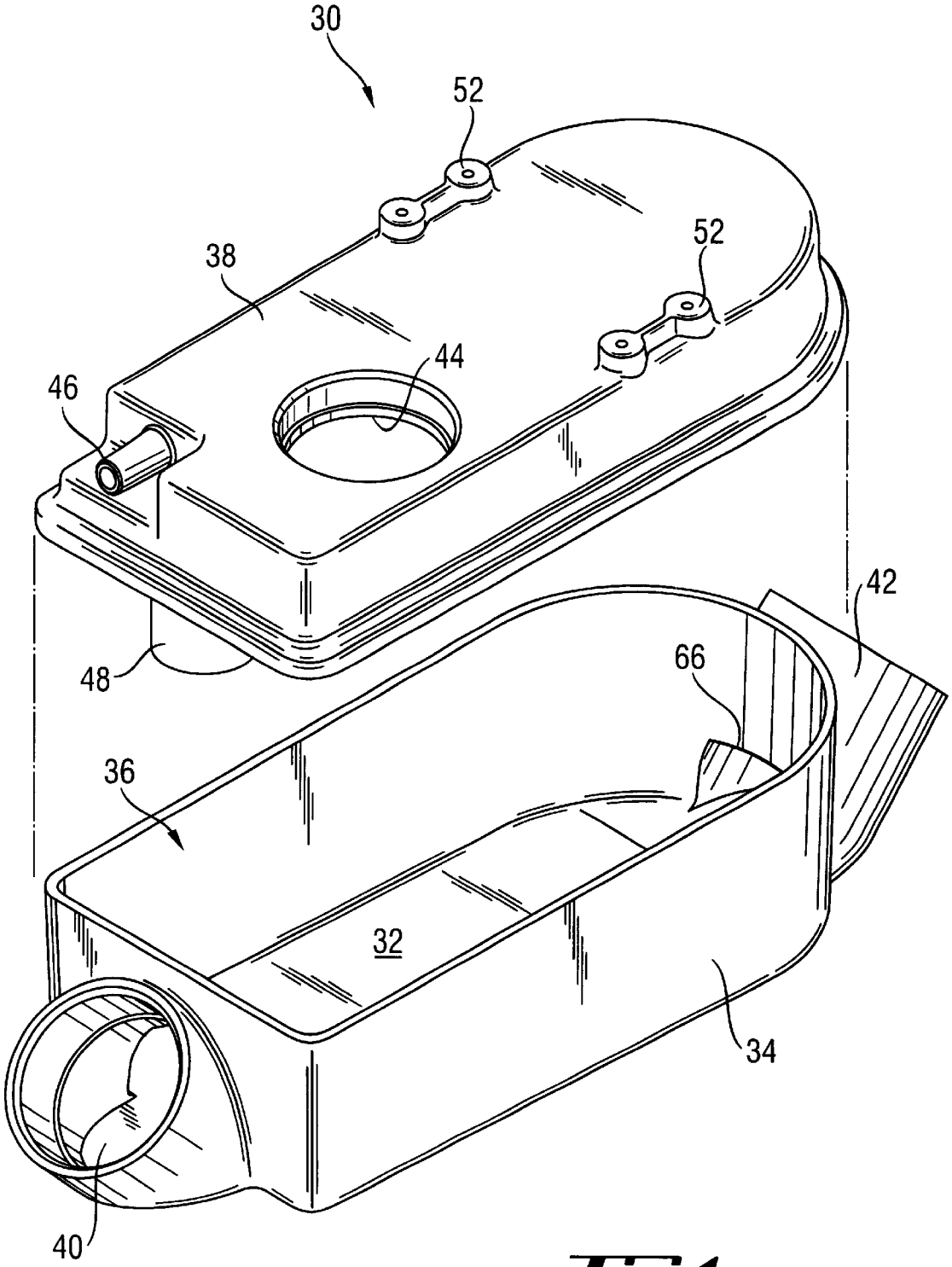
FIG. 4 is an exploded perspective view of the buffer box of FIGS. 2 and 3.

In accordance with certain aspects of the present invention, a buffer box 30 in inserted along each collection line 26 (FIG. 1). The buffer box 30 has a base portion 32 and a sidewall portion 34 which define a reservoir 36 for holding liquid, as illustrated in FIG. 4. A cover 38 is attached to a top edge of the sidewall portion 34 to enclose the reservoir 36. An inlet 40 and an outlet 42 extend through the sidewall portion 34 to communicate with the reservoir 36 (FIGS. 2–4). The inlet 40 allows liquid in the collection line 26 to flow into the buffer box 30, while the outlet 42 is directed toward the lift pipe 24. As best illustrated in FIG. 1, the buffer box 30 forms a low point in the collection line 26 so that any water entering the sloped collection line 26 flows into the buffer box 30. The cover 38 has an air intake orifice 44 which establishes communication between the reservoir 36 and atmospheric air (FIGS. 2 and 4). A pressure chamber 48 (FIG. 4) depends from a lower surface of the cover 38. An upper end of the pressure chamber 48 is closed off by the cover 38, while a lower end is open to the reservoir. The cover 38 further has a sensor port connection 46 which is in fluid communication with the pressure chamber 48.

In a preferred embodiment, a support boss 50 (FIG. 3) depends from the base portion 32 of the buffer box 30 and is located near the inlet 40. The support boss 50 creates a sloped base portion 32 which facilitates liquid flow toward the outlet 42. In addition, spacing bosses 52 project from a top surface of the cover 38. The spacing bosses 52 insure adequate clearance between the air intake orifice 44 and surrounding structure when the buffer box 30 is installed in a tight or low profile area. The importance of providing adequate spacing around to the air intake orifice 44 is more fully described below.

An activator 54 (FIG. 1) is provided for controlling operation of the valve 22 according to the liquid level in the reservoir 36. The activator has a sensor 56 (FIG. 1) connected to the sensor port connection 46 of the buffer box 30. In the currently preferred embodiment, the sensor 56 monitors pressure level in the pressure chamber 48. It will be appreciated that as the buffer box 30 fills, the liquid closes off the bottom end of the pressure chamber 48 to trap a column of air therein. When the liquid level in the reservoir 36 rises, the pressure of the trapped column of air in the pressure chamber 48 increases. Thus, the liquid level height in the reservoir 36 may be determined by measuring the pressure level in the chamber 48. While the currently preferred embodiment uses a trapped air column type of pressure sensor to detect liquid level in the buffer box 30, it will be appreciated that other types of sensors capable of detecting liquid level may also be used without departing from the scope or spirit of the present invention.

The activator 54 also has a suction line 58 which taps into the vacuum drainage piping 14 and a valve line 60 connected to the valve 22. The valve 22 is operable between open and closed positions using the negative pressure provided in the vacuum drainage piping 14 when transported through the suction and valve lines 58, 60 via the actuator 54. As a result, the activator 54 may be set so that, when a particular liquid level height is sensed, the activator 54 allows negative pressure to flow to the valve 22, thereby opening the valve.

In operation, liquid such as spent process water is directed into the inlet 28 of the collection branch 16. The liquid flows through the sloped collection line 26 to collect in the buffer box 30. When the liquid reaches a predetermined level in the buffer box 30, the activator 54 opens the valve 22 for a preset duration, which may be adjusted to change air volume. When the valve 22 is open, negative pressure acts on the liquid in the buffer box 30 at the outlet 42. Air at atmospheric pressure acts on a top surface of the liquid in the buffer box 30 through the air intake orifice 44 to thereby create a pressure differential across the liquid. The atmospheric air pushes the liquid out the inlet 42, through the lift pipe 24, and into the vacuum drainage piping 14. At the same time, air flowing through the air intake orifice 44 occupies the reservoir 36 recently evacuated by the liquid. After a predetermined amount of time, the valve 22 closes to shut off suction to the lift pipe 24 and buffer box 30. Once in the vacuum drainage piping 14, the liquid is intermittently pulled by the negative pressure in the piping until the liquid reaches the storage tank 20. In addition, the vacuum drainage piping 14 may be sloped downwardly so that gravity helps pull the liquid toward the tank 20. Liquid collected in the storage tank 20 is periodically discharged through a drain 62 to an appropriate receptacle such as a sewer line. A check valve 64 may be inserted in the vacuum drainage piping 14 to prevent liquid back flow.

In accordance with additional aspects of the present invention, the buffer box 30 is optimized to deliver substantially consistently sized slugs of liquid. As noted above, the pumps used in vacuum drainage systems 10 have a limited capacity for lifting liquid in a vertical direction. As a result, the liquid must be pulled through the lift pipe 24 in discrete volumes known as slugs, and each pump has a limited slug size which it is able to pull. Accordingly, by providing a reservoir 36 of known volume, the system may be quickly and easily adjusted to maximize slug size while avoiding broken slugs. Reservoir size is optimized primarily according to pump capacity. For example, with a pump capable of producing a vacuum of 14" Hg, the reservoir is preferably capable of producing a slug size of 1 liter, with an air to water ratio of 6:1. Under such conditions, a lift of 23 feet is reliably achieved. It will be appreciated that the buffer box 30 must be larger (i.e., on the order of 2 liters) to provide an effective reservoir volume of 1 liter.

The outlet 42 of the buffer box 30 further preferably has a fence portion 66 for optimizing liquid velocity through the lift pipe 24. The fence portion 66 defines a top edge of the outlet 42, as best shown in FIG. 4. The fence portion 66 is positioned a particular height above the base portion 32 of the buffer box 30. The height of the fence portion 66 not only affects liquid velocity through the outlet 42 but also allows control over slug formation and size by defining the height at which only liquid passes through the outlet 42. By adjusting the height of the fence portion 66, the liquid velocity may be optimized to minimize slug breakage. For example, in a buffer box installed in a 1½" diameter pipe, it has been found that the fence height should be no more than 1" and more preferably approximately ⅞". Outlet width is determined primarily by pipe size, and is preferably 1.5 to 1.8 inches for 1½" diameter piping.

In addition, the relative sizes of the inlet 40 and outlet 42 should be optimized to ensure good flow of liquid through the buffer box 30. An inlet that is too small will limit the rate at which water may be evacuated from the process, while an inlet which is too large adversely affects slug formation. Accordingly, it has been found that a preferred ratio of inlet to outlet size is approximately 2:1 to 3.5:1.

Air intake orifice size and location may be optimized so that the buffer box 30 delivers consistently sized slugs of liquid. The size of the air intake orifice 44 is preferably approximately 1.7 times as large as the area of the outlet 42, outlet size being defined herein as the cross-sectional area of the outlet 42 as reduced by the fence portion 66. In addition, the air intake orifice 44 preferably has a cross-sectional area equal to or greater than the cross-sectional area of the inlet 40. Sizing the air intake orifice 44 in this manner with respect to the inlet 40 and outlet 42 ensures that air is pulled into the buffer box 30 instead of upstream fluid. The location of the air intake orifice 44 also determines how much liquid is evacuated. The effective buffer box volume is increased the further upstream the intake air orifice 44 is located. In the preferred embodiment, the air intake orifice 44 is located in the upstream ⅓ of the buffer box 30. By optimizing the size and location of the air intake orifice 44, more consistently sized slugs are formed, thereby ensuring that the liquid is efficiently pulled through the lift pipe 24.

The buffer box 30 is preferably formed of a material which matches that of the piping to which it is connected. Accordingly, the buffer box 30 will typically be formed of PVC or ABS, which are popular pipe materials for both plumbing and evacuation systems.

The buffer box 30 is illustrated in FIG. 1 as being connected to a substantially vertical lift pipe 24. It will be appreciated that the buffer box 30 may also be used with a lift pipe that slopes (either upwardly or downwardly) or is horizontal. The benefits described herein, however, are most appreciated when the pipe 24 does not have the aid of gravity, such as when the pipe is horizontal, slopes upwardly, or is vertical.

The vacuum drainage system of the present invention has significant advantages over prior systems. By providing a buffer box having a known volume, slugs of liquid are more efficiently and reliably evacuated. In addition, the outlet fence portion increases the effective volume of the buffer box and provides control over liquid discharge velocity. Furthermore, the buffer box has an optimally sized air intake orifice which creates more consistently sized slugs of liquid. As a result, a vacuum drainage system using the buffer box described herein more efficiently evacuates liquid through lift pipes.

The foregoing detailed description has been given for clearness of understanding only, and no unnecessary limitations should be understood therefrom, as modifications would be obvious to those skilled in the art.

What is claimed is:

1. A buffer box for use in a vacuum collection system having a drainage pipe maintained under partial vacuum pressure, a suction valve for selectively controlling access to the drainage pipe, and a collection pipe having an inlet adapted to collect waste fluid from a waste fluid source, the buffer box comprising:

a base;

a side wall extending upwardly from the base;

a cover attached to the side wall so that an interior of the base, side wall, and cover define a reservoir;

an inlet fluidly communicating between the collection pipe and the reservoir;

an outlet formed in the side wall adapted to fluidly communicate with the suction valve; and an air intake orifice integrally provided with the buffer box and fluidly communicating between the reservoir and atmosphere;

wherein waste fluid collecting in the reservoir is transported to the drainage pipe when the suction valve actuates to an open position.

2. The buffer box of claim 1, in which the air intake orifice is formed in the cover.

3. The buffer box of claim 1, in which the air intake orifice is located in an upstream ⅓ of the buffer box.

4. The buffer box of claim 1, in which the air intake orifice has a cross-sectional area equal to at least a cross-sectional area of the inlet.

5. The buffer box of claim 1, in which the air intake orifice and outlet have respective cross-sectional areas, and in which a ratio of the cross-sectional area of the air intake orifice to the cross-sectional area of the outlet is approximately 1.7:1.

6. The buffer box of claim 1, further comprising a liquid level sensor formed integrally with the buffer box and disposed inside the reservoir.

7. The buffer box of claim 6, in which the liquid level sensor comprises a pressure chamber attached to the cover and extending into the reservoir.

8. The buffer box of claim 1, in which an upper edge of the outlet is formed with a substantially horizontal fence portion.

9. The buffer box of claim 1, in which the inlet and outlet have respective cross-sectional areas, and in which a ratio of the inlet cross-sectional area to the outlet cross-sectional area is approximately 2 to 3.5:1.

10. A buffer box for use in a vacuum collection system having a drainage pipe maintained under partial vacuum pressure, a suction valve for selectively controlling access to the drainage pipe, and a collection pipe having an inlet adapted to collect waste fluid from a waste fluid source, the buffer box comprising:

a base;

a side wall extending upwardly from the base and having upstream and downstream ends;

a cover attached to the side wall so that an interior of the base, side wall, and cover define a reservoir;

an inlet formed in the upstream end of the side wall adapted to fluidly communicate with the collection pipe;

an outlet formed in the downstream end of the side wall adapted to fluidly communicate with the suction valve; and an air intake orifice integrally provided with the buffer box and fluidly communicating between the reservoir and atmosphere;

wherein waste fluid collecting in the reservoir is transported to the drainage pipe when the suction valve actuates to an open position.

11. The buffer box of claim 10, in which the air intake orifice is formed in the cover.

12. The buffer box of claim 11, in which the cover further comprises upwardly extending spacing bosses.

13. The buffer box of claim 11, in which the air intake orifice is located in an upstream ⅓ of the buffer box.

14. The buffer box of claim 10, in which the base slopes downwardly from the upstream end to the downstream end.

15. The buffer box of claim 10, in which the air intake orifice has a cross-sectional area equal to at least a cross-sectional area of the inlet.

16. The buffer box of claim 10, in which the air intake orifice and outlet have respective cross-sectional areas, and in which a ratio of the cross-sectional area of the air intake orifice to the cross-sectional area of the outlet is approximately 1.7:1.

17. The buffer box of claim 10, in which an upper edge of the outlet is formed with a substantially horizontal fence portion.

18. The buffer box of claim 10, in which the inlet and outlet have respective cross-sectional areas, and in which a ratio of the inlet cross-sectional area to the outlet cross-sectional area is approximately 2 to 3.5:1.

19. A buffer box for use in a vacuum collection system having a drainage pipe maintained under partial vacuum pressure, a suction valve for selectively controlling access to the drainage pipe, and a collection pipe having an inlet adapted to collect waste fluid from a waste fluid source, the buffer box comprising:

a base;

a side wall extending upwardly from the base and having upstream and downstream ends;

a cover attached to the side wall so that an interior of the base, side wall, and cover define a reservoir;

an inlet formed in the upstream end of the side wall adapted to fluidly communicate with the collection pipe;

an outlet formed in the downstream end of the side wall adapted to fluidly communicate with the suction valve;

an air intake orifice provided integrally with the buffer box and fluidly communicating between the reservoir and atmosphere; and a liquid level sensor provided integrally with the buffer box and supported inside the reservoir at a fixed height above the base;

wherein waste fluid collecting in the reservoir is transported to the drainage pipe when the suction valve actuates to an open position.

20. The buffer box of claim 19, in which the liquid level sensor comprises a pressure chamber attached to the cover and extending into the reservoir.

21. The buffer box of claim 20, in which the cover further comprises a sensor port in fluid communication with the pressure chamber.

22. The buffer box of claim 19, in which the air intake orifice is formed in the cover.

23. The buffer box of claim 19, in which the air intake orifice is located in an upstream ⅓ of the buffer box.

24. The buffer box of claim 19, in which the air intake orifice has a cross-sectional area equal to at least a cross-sectional area of the inlet.

25. The buffer box of claim 19, in which the air intake orifice and outlet have respective cross-sectional areas, and in which a ratio of the cross-sectional area of the air intake orifice to the cross-sectional area of the outlet is approximately 1.7:1.

26. The buffer box of claim 19, in which an upper edge of the outlet is formed with a substantially horizontal fence portion.

27. The buffer box of claim 19, in which the inlet and outlet have respective cross-sectional areas, and in which a ratio of the inlet cross-sectional area to the outlet crosssectional area is approximately 2 to 3.5:1.

28. The buffer box of claim 19, in which the cover further comprises upwardly extending spacing bosses.

* * * * *